US009840794B2

(12) United States Patent
Seidel et al.

(10) Patent No.: US 9,840,794 B2
(45) Date of Patent: Dec. 12, 2017

(54) ELASTIC NONWOVEN FIBROUS WEBS AND METHODS OF MAKING AND USING

(75) Inventors: David L. Seidel, Woodbury, MN (US); Troy K. Ista, River Falls, WI (US); Timothy J. Lindquist, Woodbury, MN (US); Scott J. Tuman, Woodbury, MN (US)

(73) Assignee: 3M INNOVATIVE PROPERTIES COMPNAY, St. Paul, MN (US)

( * ) Notice: Subject to any disclaimer, the term of this patent is extended or adjusted under 35 U.S.C. 154(b) by 1809 days.

(21) Appl. No.: 13/141,185

(22) PCT Filed: Dec. 16, 2009

(86) PCT No.: PCT/US2009/068222

§ 371 (c)(1),
(2), (4) Date: Jun. 21, 2011

(87) PCT Pub. No.: WO2010/077929

PCT Pub. Date: Jul. 8, 2010

(65) Prior Publication Data

US 2011/0256791 A1 Oct. 20, 2011

Related U.S. Application Data

(60) Provisional application No. 61/141,396, filed on Dec. 30, 2008.

(51) Int. Cl.

| | |
|---|---|
| ***D04H 5/02*** | (2012.01) |
| ***D04H 1/732*** | (2012.01) |
| ***D04H 5/03*** | (2012.01) |

(52) U.S. Cl.
CPC ..... *D04H 5/02* (2013.01); *D04H 1/732* (2013.01); *D04H 5/03* (2013.01); *Y10T 442/602* (2015.04)

(58) Field of Classification Search
USPC ..... 442/329; 28/104; 15/208
See application file for complete search history.

(56) References Cited

U.S. PATENT DOCUMENTS

| | | | |
|---|---|---|---|
| 1,975,504 | A | 10/1934 | Formhals |
| 3,686,385 | A | 8/1972 | Rohn |
| 3,783,649 | A | 1/1974 | Yamamoto et al. |
| 3,855,045 | A | 12/1974 | Brock |
| 3,874,886 | A | 4/1975 | Levecque et al. |
| 3,959,421 | A | 5/1976 | Weber et al. |
| 3,971,373 | A | 7/1976 | Braun |
| 4,086,381 | A | 4/1978 | Cheshire et al. |

(Continued)

FOREIGN PATENT DOCUMENTS

| | | |
|---|---|---|
| AU | 713528 B2 | 12/1999 |
| CN | 101230519 | 7/2008 |

(Continued)

*Primary Examiner* — Lynda Salvatore
(74) *Attorney, Agent, or Firm* — James A. Baker

(57) ABSTRACT

Nonwoven fibrous webs include elastic filaments such that the web as a whole exhibits elastic properties when stretched. The webs include a multiplicity of nonwoven fibers and at least one elastic filament entangled with at least a portion of the nonwoven fibers to form a self-supporting, cohesive, elastic nonwoven fibrous web. Methods of making such elastic nonwoven fibrous webs using hydro-entanglement, and uses of such webs to form articles are also described.

11 Claims, 4 Drawing Sheets

(56) References Cited

U.S. PATENT DOCUMENTS

| | | | | |
|---|---|---|---|---|
| 4,118,531 | A | | 10/1978 | Hauser |
| 4,147,749 | A | | 4/1979 | Lipscomb et al. |
| 4,163,819 | A | | 8/1979 | Yung et al. |
| 4,164,600 | A | | 8/1979 | Yung et al. |
| 4,189,338 | A | | 2/1980 | Ejima et al. |
| 4,363,646 | A | | 12/1982 | Torobin |
| 4,405,297 | A | | 9/1983 | Appel et al. |
| 4,536,361 | A | | 8/1985 | Torobin |
| 4,692,371 | A | | 9/1987 | Morman et al. |
| 4,707,398 | A | | 11/1987 | Boggs |
| 4,813,948 | A | | 3/1989 | Insley |
| 4,820,572 | A | | 4/1989 | Killian et al. |
| 4,891,957 | A | | 1/1990 | Strack et al. |
| 5,082,720 | A | | 1/1992 | Hayes |
| 5,227,107 | A | | 7/1993 | Dickenson et al. |
| 5,296,286 | A | | 3/1994 | Allen et al. |
| 5,322,728 | A | | 6/1994 | Davey et al. |
| 5,366,793 | A | * | 11/1994 | Fitts et al. ..... 428/198 |
| 5,389,202 | A | | 2/1995 | Everhart et al. |
| 5,460,500 | A | | 10/1995 | Geus et al. |
| 5,470,639 | A | | 11/1995 | Gessner et al. |
| 5,496,507 | A | | 3/1996 | Angadjivand et al. |
| 5,613,986 | A | | 3/1997 | Bessey et al. |
| 5,635,290 | A | | 6/1997 | Stopper et al. |
| 5,652,051 | A | | 7/1997 | Shawver et al. |
| 5,714,107 | A | | 2/1998 | Levy et al. |
| 5,997,989 | A | | 12/1999 | Gessner et al. |
| 6,057,256 | A | | 5/2000 | Krueger et al. |
| 6,114,017 | A | | 9/2000 | Fabbricante et al. |
| 6,165,217 | A | | 12/2000 | Hayes |
| 6,183,670 | B1 | | 2/2001 | Torobin et al. |
| 6,183,684 | B1 | | 2/2001 | Lu |
| 6,269,513 | B1 | | 8/2001 | Torobin |
| 6,274,238 | B1 | | 8/2001 | DeLucia |
| 6,315,806 | B1 | | 11/2001 | Torobin et al. |
| 6,382,526 | B1 | | 5/2002 | Reneker et al. |
| 6,607,624 | B2 | | 8/2003 | Berrigan et al. |
| 6,743,273 | B2 | | 6/2004 | Chung et al. |
| 6,800,226 | B1 | | 10/2004 | Gerking |
| 6,851,164 | B2 | | 2/2005 | Andersen |
| 6,861,025 | B2 | | 3/2005 | Erickson et al. |
| 6,903,302 | B2 | | 6/2005 | Kim et al. |
| 6,916,752 | B2 | | 7/2005 | Berrigan et al. |
| 7,091,140 | B1 | | 8/2006 | Ferencz et al. |
| 7,195,814 | B2 | | 3/2007 | Ista et al. |
| 2002/0102897 | A1 | | 8/2002 | Berrigan et al. |
| 2003/0216096 | A1 | | 11/2003 | Berrigan et al. |
| 2003/0216099 | A1 | | 11/2003 | Berrigan et al. |
| 2008/0026661 | A1 | | 1/2008 | Fox et al. |

FOREIGN PATENT DOCUMENTS

| | | | | |
|---|---|---|---|---|
| DE | 199 29 709 | A1 | 12/2000 | |
| EP | 0 322 136 | A2 | 6/1989 | |
| EP | 0 725 174 | A1 | 8/1996 | |
| EP | 1 101 854 | A1 | 5/2001 | |
| EP | 1876277 | * | 4/2006 | ..... D04H 3/16 |
| JP | 47-38914 | | 10/1972 | |
| JP | 8-188950 | | 7/1996 | |
| JP | 9-500936 | | 1/1997 | |
| JP | 9-31819 | | 2/1997 | |
| JP | 9-316765 | | 12/1997 | |
| JP | 10-72756 | | 3/1998 | |
| JP | 2002-242069 | | 8/2002 | |
| JP | 2003-278057 | | 10/2003 | |
| JP | 2008-284717 | | 11/2008 | |
| WO | 95/04182 | | 2/1995 | |
| WO | 02/055782 | A2 | 7/2002 | |
| WO | 03/04831 | A1 | 6/2003 | |
| WO | 03/076179 | A1 | 9/2003 | |
| WO | 2007/001990 | A2 | 1/2007 | |

* cited by examiner

ELASTIC NONWOVEN FIBROUS WEBS AND METHODS OF MAKING AND USING

CROSS REFERENCE TO RELATED APPLICATION

This application claims the benefit of U.S. Provisional Patent Application No. 61/141,396, filed Dec. 30, 2008, the disclosure of which is incorporated by reference herein in its entirety.

TECHNICAL FIELD

The present disclosure relates to nonwoven fibrous webs that include elastic filaments such that the web as a whole exhibits elastic properties when stretched. The disclosure further relates to methods of making such elastic nonwoven fibrous webs, and uses of such webs to form articles.

BACKGROUND

Important commercial opportunities await nonwoven fibrous webs that are suitably stretchable, elastic and strong. Such webs could be useful to make a garment form-fitting, or to make a cuff, neck-line or other portion of a garment elastically retain its shape. Or such webs could provide breathable, soft, lightweight, cloth-like fabrics. Also, such webs tend to be of high friction, which can be useful in a number of applications.

Recognizing the opportunities, many prior workers have sought to produce elastic nonwoven fibrous webs. Their prior work is represented in the patent literature, which includes U.S. Pat. Nos. 3,686,385; 4,707,398; 4,820,572; 4,891,957; 5,322,728; 5,366,793; 5,470,639; and 5,997,989. While the prior work may have met some needs, many opportunities remain unsatisfied. In general, the prior efforts have not produced a fibrous web having an adequate combination of stretchability, elasticity, breathability, and strength to fulfill many of the opportunities.

SUMMARY

In one aspect, the disclosure relates to an en elastic nonwoven fibrous web comprising a plurality of nonwoven fibers and at least one elastic filament entangled with at least a portion of the plurality of nonwoven fibers to form a self-supporting, cohesive, elastic nonwoven fibrous web. In another aspect, the disclosure relates to an elastic nonwoven fibrous web comprising a plurality of nonwoven fibers and at least one elastic filament hydraulically entangled with at least a portion of said plurality of nonwoven fibers to form a web, wherein the web is self-supporting and exhibits elasticity. In some exemplary embodiments, the elastic nonwoven fibrous web exhibits a Stretch Ratio of at least 1.5. In other exemplary embodiments, the elastic nonwoven fibrous web exhibits a Stretch Ratio of at least 2.

In further exemplary embodiments, the plurality of nonwoven fibers comprises fibers selected from microfibers, ultrafine microfibers, sub-micrometer fibers, and combinations thereof. In certain exemplary embodiments, the plurality of nonwoven fibers comprises fibers selected from meltblown fibers, melt spun fibers, air laid fibers, carded fibers, and combinations thereof. In some exemplary embodiments, the plurality of nonwoven fibers comprises fibers selected from natural fibers, synthetic fibers, and combinations thereof. In some particular exemplary embodiments, the plurality of nonwoven fibers comprises polypropylene, polyethylene, polyester, polyethylene terephthalate, polybutylene terephthalate, polyamide, polyimide, polyurethane, polybutene, polylactic acid, polyvinyl alcohol, polyphenylene sulfide, polysulfone, liquid crystalline polymer, polyethylene-co-vinylacetate, polyacrylonitrile, cyclic polyolefin, polyoxymethylene, polyolefinic thermoplastic elastomers, cellulose, cellulose acetate, or a combination thereof.

In related exemplary embodiments, the at least one elastic filament exhibits an elongation to break of at least 200%, and, when released from tension after stretching to twice an original length, retreats to no more than 125% of the original length. In certain exemplary embodiments, the at least one elastic filament comprises a plurality of elastic filaments. In certain exemplary embodiments, the at least one elastic filament comprises at least one elastomeric filament. In some particular exemplary embodiments, the at least one elastic filament comprises a (co)polymer selected from a urethane block copolymer, a styrenic block copolymer, an aliphatic polyester, an aliphatic polyamide, and combinations thereof.

In another aspect, exemplary embodiments of the present disclosure also provide methods for making elastic nonwoven fibrous webs, which in brief summary, comprise:

(a) providing a plurality of nonwoven fibers;

(b) providing at least one elastic filament under a tension so as to stretch the at least one elastic filament from a relaxed state to a stretched state;

(c) entangling at least a portion of said plurality of nonwoven fibers with said at least one elastic filament while maintaining said at least one elastic filament under the tension;

(d) releasing the tension so as to allow the at least one elastic filament to retract from the stretched state, thereby form a self-supporting, cohesive, elastic nonwoven fibrous web.

In certain exemplary embodiments, entangling at least a portion of said plurality of nonwoven fibers with said at least one elastic filament comprises hydro-entangling. In some exemplary embodiments, the method further comprises drying the self-supporting, cohesive, elastic nonwoven fibrous web.

In further exemplary embodiments, the plurality of nonwoven fibers is provided in the form of at least one nonwoven fibrous web. In some exemplary embodiments, the plurality of nonwoven fibers is provided in the form of two or more nonwoven fibrous webs. In certain exemplary embodiments, at least one of the two or more nonwoven fibrous webs comprises nonwoven fibers that differ from nonwoven fibers in at least one of the other nonwoven fibrous webs. In certain presently preferred embodiments, the at least one nonwoven fibrous web is substantially non-bonded.

In additional exemplary embodiments, the plurality of nonwoven fibers comprises fibers selected from microfibers, ultrafine microfibers, sub-micrometer fibers, and combinations thereof. In some exemplary embodiments, the plurality of nonwoven fibers comprises fibers selected from meltblown fibers, melt spun fibers, air laid fibers, carded fibers, and combinations thereof. In certain exemplary embodiments, the plurality of nonwoven fibers comprises natural fibers, synthetic fibers, and combinations thereof. In further exemplary embodiments, the plurality of nonwoven fibers comprises polypropylene, polyethylene, polyester, polyethylene terephthalate, polybutylene terephthalate, polyamide, polyimide, polyurethane, polybutene, polylactic acid, polyvinyl alcohol, polyphenylene sulfide, polysulfone, liquid crystalline polymer, polyethylene-co-vinylacetate, polyacrylonitrile, cyclic polyolefin, polyoxymethylene, polyolefinic thermoplastic elastomers, cellulose, cellulose acetate, or a combination thereof.

In other presently preferred embodiments, the at least one elastic filament comprises a plurality of elastic filaments, and a filament spacing comb is used to maintain a separation between the plurality of elastic filaments prior to entangling at least a portion of said plurality of nonwoven fibers with said plurality of elastic filaments.

In certain exemplary embodiments, the at least one elastic filament comprises a monofilament. In other exemplary embodiments, the at least one elastic filament comprises an at least partially fused multi-filament yarn. In additional exemplary embodiments, the at least one elastic filament comprises at least one elastomeric filament. In some exemplary embodiments, the at least one elastic filament comprises a (co)polymer selected from a urethane block copolymer, a styrenic block copolymer, an aliphatic polyester, an aliphatic polyamide, and combinations thereof.

In yet another aspect, exemplary embodiments of the present disclosure provide an article comprising an elastic nonwoven fibrous web as previously described, wherein the article is selected from a wound dressing article, a personal hygiene article, a surface cleaning article, a gas filtration article, a liquid filtration article, a sound absorption article, a thermal insulation article a cellular growth support article, or a drug delivery article.

Various aspects and advantages of exemplary embodiments of the presently disclosed invention have been summarized. The above Summary is not intended to describe each illustrated embodiment or every implementation of the presently disclosed invention. The Drawings and the Detailed Description that follow more particularly exemplify certain preferred embodiments using the principles disclosed herein.

BRIEF DESCRIPTION OF THE DRAWINGS

Exemplary embodiments of the present disclosure are further described with reference to the appended figures, wherein.

DETAILED DESCRIPTION

Glossary

Figure 1:
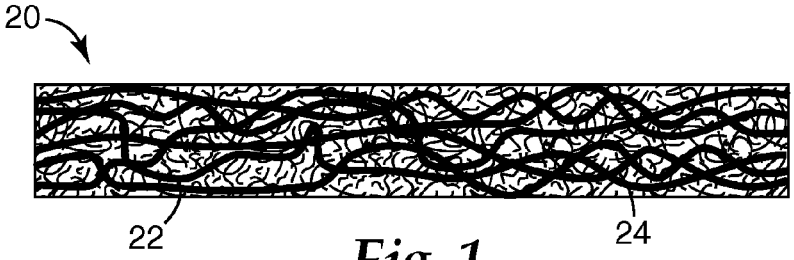
FIG. 1 is a schematic side view of an exemplary elastic nonwoven fibrous web of the present disclosure.

As used herein:

"(Co)polymer" refers to a homopolymer or a copolymer.

"Filament" is used to denote a continuous elongated strand of material.

"Fiber is used to denote a discontinuous or discrete elongate strand of material. The term "fiber" as used herein includes monocomponent fibers; bicomponent or conjugate fibers (for convenience, the term "bicomponent" will often be used to mean fibers that consist of two components as well as fibers that consist of more than two components); and a fiber section of a bicomponent fiber, i.e., a section occupying part of the cross-section of and extending over the length of the bicomponent fiber. Core-sheath or side-by-side bicomponent fibers are also included.

"Microfiber" refers to a population of fibers having a population median diameter of at least one micrometer.

"Ultrafine Microfiber" refers to a population of fibers having a population median diameter of two micrometers or less.

"Sub-micrometer Filament" refers to a population of fibers having a population median diameter of less than one micrometer.

"Oriented" as used herein to refer to a population of fibers or filaments refers to fibers or filaments arranged or collected so that at least the longitudinal axes of two or more of the fibers or filaments are aligned in the same direction.

"Oriented polymer" means that portions of polymer molecules within a fiber or filament are aligned lengthwise within the fiber or filament, and are locked in, i.e., are thermally fixed or trapped in, that alignment. In other words, for the molecules to move out of their orienting alignment would require the fibers to be heated above the relaxation temperature for the fibers for sufficient time that the molecules would be free to move and rearrange themselves sufficiently to lose their orientation ["relaxation temperature" is defined herein as a temperature that is within plus or minus 5° C. of the glass transition temperature (for amorphous non-crystalline materials) or melting temperature (for crystalline or semi-crystalline materials)]. The aligned molecules can improve strength properties of the fibers.

Whether molecules are oriented within a fiber can generally be indicated by measuring whether the fibers exhibit birefringence. If fibers exhibit a birefringence number of at least about $1\times10^{-5}$ by the test described herein, they are regarded as oriented. The higher the birefringence number, the higher the degree of orientation, and preferably fibers in webs of the presently disclosed invention exhibit a birefringence number of at least $1\times10^{-4}$ or at least $1\times10^{-3}$; and with certain polymers we have successfully prepared fibers with birefringence numbers of $1\times10^{-2}$ or more. Fibers of different polymer classes may show different degrees of orientation and different levels of birefringence number.

"Molecularly same polymer" refers to polymers that have essentially the same repeating molecular unit, but which may differ in molecular weight, method of manufacture, commercial form, etc.

By "orienting temperature" is meant a temperature at which molecules making up a fiber or filament can move into alignment lengthwise within the fiber or filament under attenuation or drawing stress; such a temperature is generally at least about or greater than the glass transition ($T_g$) or melting point ($T_m$) for the filaments.

By "orientation-locking temperature" is meant a temperature at which the molecules making up a fiber or filament become thermally fixed or trapped into an orientation they may have attained within the fiber or filament. Such a temperature is generally at least about 30° C. less than the relaxation temperature for the fiber or filament.

When reference is made herein to a batch, group, array, layer, etc. of a particular kind of fiber or filament, e.g., "a layer of sub-micrometer fibers," it means the complete population of fibers or filaments in that layer, or the complete population of a single batch of fibers or filaments, and not only that portion of the layer or batch that is sub-micrometer dimensions.

"Self supporting" or "self sustaining" in describing a nonwoven fibrous web means that the web can be held, handled and processed by itself, without any additional supporting structure.

"Cohesive" in describing a nonwoven fibrous web means that the web is held together primarily by mechanical entanglement of the fibers and filaments comprising the web, and substantially not by adhesive bonding between the fibers and the filaments.

"Solidity" is a nonwoven web property inversely related to density and characteristic of web permeability and porosity (low Solidity corresponds to high permeability and high porosity), and is defined by the equation:

$$\text{Solidity (\%)} = \frac{[3.937 * \text{Web Basis Weight}(g/m^2)]}{[\text{Web Thickness}(mils) * \text{Bulk Density}(g/cm^3)]}$$

"Web Basis Weight" is calculated from the weight of a 10 cm×10 cm web sample.

"Web Thickness" is measured on a 10 cm×10 cm web sample using a thickness testing gauge having a tester foot with dimensions of 5 cm×12.5 cm at an applied pressure of 150 Pa.

"Bulk Density" is the bulk density of the polymer or polymer blend that makes up the web, taken from the literature.

By "directly formed fibers" it is meant fibers formed and collected as a fibrous nonwoven web in essentially one operation, e.g., by extruding filaments from a fiber-forming liquid, processing the extruded filaments to a solidified fiber form as they travel to a collector, and collecting the processed fibers as a web within seconds after the fibers left the liquid form. Such a method is in contrast with methods in which, for example, extruded fibers are chopped into staple fibers before they are assembled into a web. Meltblown fibers and meltspun fibers, including spunbond fibers and fibers prepared and collected in webs in the manner described in U.S. Pat. No. 6,607,624, are examples of directly formed fibers.

"Meltblown" or "Melt-blown" herein refers to fibers prepared by extruding molten fiber component through orifices in a die into a high-velocity gaseous stream, wherein the extruded material is first attenuated and then solidifies as a mass of fibers.

"Spunbond" or "Spun-bond" herein refers to filaments prepared by extruding molten filament-forming material through orifices in a die into a low-velocity, optionally heated, gaseous stream, which then solidify as a mass of thermally-bonded filaments.

"Autogenous bonding" is defined as bonding between filaments at an elevated temperature as obtained in an oven or with a through-air bonder without application of direct contact pressure such as in point-bonding or calendering.

Various exemplary embodiments of the disclosure will now be described with particular reference to the Drawings. Exemplary embodiments of the presently disclosed invention may take on various modifications and alterations without departing from the spirit and scope of the disclosure. Accordingly, it is to be understood that the embodiments of the presently disclosed invention are not to be limited to the following described exemplary embodiments, but is to be controlled by the limitations set forth in the claims and any equivalents thereof.

A. Elastic Nonwoven Fibrous Webs

FIG. 1 illustrates an exemplary elastic nonwoven fibrous web 20 according to certain embodiments of the present disclosure. The embodiment illustrated by FIG. 1 shows a plurality of nonwoven fibers 22 and at least one elastic filament 24 entangled with at least a portion of the plurality of nonwoven fibers 22 to form a self-supporting, cohesive, elastic nonwoven fibrous web 20. Although FIG. 1 illustrates an exemplary embodiment in which the at least one elastic filament 24 comprises a plurality of elastic filaments, it should be understood that a single filament 24 may be used in other embodiments.

Elastic nonwoven fibrous webs 20 as presently disclosed are self-supporting, cohesive, and exhibit elastic properties when stretched from a relaxed state. In some exemplary embodiments, the elastic nonwoven fibrous web 20 exhibits a Stretch Ratio of at least 1.1, 1.2, 1.3, 1.4, or 1.5. In other exemplary embodiments, the elastic nonwoven fibrous web 20 exhibits a Stretch Ratio of at least 2. Though having elasticity, webs of the present disclosure can be, and preferably are, dimensionally stable. By "dimensionally stable" it is meant that the web will shrink in its width dimension (transverse to the machine direction) by no more than about 10 percent when heated to a temperature of 70° C.

1. Nonwoven Fiber Component

The elastic nonwoven fibrous webs of the present disclosure include a plurality of nonwoven fibers. Preferably, the plurality of nonwoven fibers is provided in the form of a pre-formed web of nonwoven fibers. Preferably, the pre-formed web of nonwoven fibers is substantially unbonded; that is, the fibers form a self-support web (e.g., by entanglement), but are not substantially adhesively bonded to each other.

The nonwoven fibrous web comprising the plurality of nonwoven fibers may be formed from a fiber stream in any number of ways, and is not particularly limited. Suitable fiber streams from which to make a nonwoven fibrous web include known methods of generating nonwoven fibers, as well as other methods that provide an opportunity to combine the particulates with a fiber stream formed during the web forming process. In certain exemplary embodiments, the fiber streams may comprise sub-micrometer fibers, ultra-fine microfibers, fine microfibers, microfibers, or a blend of one or more thereof. Other components such as staple fibers or particles or other nonwoven fibers can be collected together with the population of nonwoven fibers to form nonwoven fibrous webs useful in practicing certain embodiments of the present disclosure.

A number of processes may be used to produce a sub-micrometer fiber stream, including, but not limited to melt blowing, melt spinning, electrospinning, gas jet fibrillation, or combination thereof. Particularly suitable processes include, but are not limited to, processes disclosed in U.S. Pat. Nos. 3,874,886 (Levecque et al.); 4,363,646 (Torobin); 4,536,361 (Torobin); 5,227,107 (Dickenson et al.); 6,183,670 (Torobin); 6,269,513 (Torobin); 6,315,806 (Torobin); 6,743,273 (Chung et al.); 6,800,226 (Gerking); German Patent DE 19929709 C2 (Gerking); and PCT Pub. No. WO 2007/001990 A2 (Krause et al.).

Suitable processes for forming sub-micrometer fibers also include electrospinning processes, for example, those processes described in U.S. Pat. No. 1,975,504 (Formhals). Other suitable processes for forming sub-micrometer fibers are described in U.S. Pat. Nos. 6,114,017 (Fabbricante et al.); 6,382,526 B1 (Reneker et al.); and 6,861,025 B2 (Erickson et al.).

A number of processes may also be used to produce a microfiber stream, including, but not limited to, melt blowing, melt spinning, filament extrusion, plexifilament formation, spunbonding, wet spinning, dry spinning, or a combination thereof. Suitable melt spinning processes are described in U.S. Patent Pub. No. 2008/0026661 (Fox et al.). Other suitable processes for forming microfibers are described in U.S. Pat. Nos. 6,315,806 (Torobin); 6,114,017 (Fabbricante et al.); 6,382,526 B1 (Reneker et al.); and 6,861,025 B2 (Erickson et al.). Alternatively, a population of microfibers may be formed or converted to staple fibers and combined with a population of sub-micrometer fibers using, for example, using a process as described in U.S. Pat. No. 4,118,531 (Hauser).

In certain exemplary embodiments, a population of fine, ultrafine or sub-micrometer fibers may be combined with a population of coarse microfibers to pre-form a nonwoven fibrous web comprising an inhomogenous mixture of fibers. In certain exemplary embodiments, at least a portion of the population of fine, ultrafine or sub-micrometer fibers is intermixed with at least a portion of the population of microfibers. In other exemplary embodiments, the population of fine, ultrafine or sub-micrometer fibers may be formed as an overlayer on an underlayer comprising the population of microfibers. In certain other exemplary embodiments, the population of microfibers may be formed as an overlayer on an underlayer comprising the population of fine, ultrafine or sub-micrometer fibers.

In some exemplary embodiments, a preferred fiber component is a microfiber component comprising fibers having a median fiber diameter of at least about 1 μm. In certain embodiments, a preferred fiber component is a microfiber component comprising fibers having a median fiber diameter of at most about 200 μm. In some exemplary embodiments, the microfiber component comprises fibers have a median fiber diameter ranging from about 1 μm to about 100 μm. In other exemplary embodiments, the microfiber component comprises fibers have a median fiber diameter ranging from about 5 μm to about 75 μm, or even about 10 μm to about 50 μm. In certain particularly preferred embodiments, the microfiber component comprises fibers have a median fiber diameter ranging from about 15 μm to about 30 μm.

In the present disclosure, the "median fiber diameter" of fibers in a given microfiber component is determined by producing one or more images of the fiber structure, such as by using a scanning electron microscope; measuring the fiber diameter of clearly visible fibers in the one or more images resulting in a total number of fiber diameters, x; and calculating the median fiber diameter of the x fiber diameters. Typically, x is greater than about 50, and desirably ranges from about 50 to about 200. Preferably, the standard deviation about the median fiber diameter is at most about 2 micrometers, more preferably at most about 1.5 micrometers, most preferably at most about 1 micrometer.

In some exemplary embodiments, the plurality of nonwoven fibers comprises fibers selected from synthetic fibers, natural fibers, and combinations thereof. A wide variety of materials may be used as fiber components in the nonwoven fibrous web(s). Suitable fiber components are described in U.S. Pat. No. 7,195,814 B2 (Ista et al.). Presently preferred fiber components generally comprise organic polymeric or copolymeric (i.e., (co)polymeric) materials. Suitable (co) polymeric materials include, but are not limited to, polyolefins such as polypropylene and polyethylene; polyesters such as polyethylene terephthalate and polybutylene terephthalate; polyamides (e.g., Nylon-6 and Nylon-6,6); polyimides, polyurethanes; polybutene; polylactic acids; polyvinyl alcohol; polyphenylene sulfide; polysulfone; liquid crystalline polymers; polyethylene-co-vinylacetate; polyacrylonitrile; cyclic polyolefins; polyoxymethylene; polyolefinic thermoplastic elastomers; or a combination thereof. The specific polymers listed here are examples only, and a wide variety of other (co)polymeric or fiber components are useful.

A variety of natural fiber components may also be used to make elastic nonwoven fibrous webs according to certain exemplary embodiments of the present disclosure. Preferred natural materials include cellulose and cellulose acetate.

Fibers also may be formed from blends of materials, including materials into which certain additives have been blended, such as pigments or dyes. Bi-component spunbond fibers, such as core-sheath or side-by-side bi-component fibers, may be prepared ("bi-component" herein includes fibers with two or more components, each component occupying a part of the cross-sectional area of the fiber and extending over a substantial length of the fiber), as may be bicomponent sub-micrometer fibers. However, exemplary embodiments of the disclosure may be particularly useful and advantageous with monocomponent fibers (in which the fibers have essentially the same composition across their cross-section, but "monocomponent" includes blends or additive-containing materials, in which a continuous phase of substantially uniform composition extends across the cross-section and over the length of the fiber). Among other benefits, the ability to use single-component fibers reduces complexity of manufacturing and places fewer limitations on use of the web.

Some polymers or materials that are more difficult to form into fibers by spunbond or meltblown techniques may also be used with the above mentioned materials. In the case of semicrystalline polymeric materials, preferred embodiments of the presently disclosed invention provide nonwoven fibrous webs comprising chain-extended crystalline structure (also called strain-induced crystallization) in the fibers, thereby increasing strength and stability of the web (chain-extended crystallization, as well as other kinds of crystallization, typically can be detected by X-ray analysis).

In addition to the fiber components mentioned above, various additives may be added to the fiber melt and extruded to incorporate the additive into the fiber. Typically, the amount of additives is less than about 25 wt %, desirably, up to about 5.0 wt %, based on a total weight of the fiber. Suitable additives include, but are not limited to, particulates, fillers, stabilizers, plasticizers, flow control agents, cure rate retarders, surface adhesion promoters (for example, silanes and titanates), adjuvants, impact modifiers, expandable microspheres, thermally conductive particles, electrically conductive particles, silica, glass, clay, talc, pigments, colorants, glass beads or bubbles, antioxidants, optical brighteners, antimicrobial agents, surfactants, fire retardants, and fluorochemicals.

One or more of the above-described additives may be used to reduce the weight and/or cost of the resulting fiber and layer, adjust viscosity, or modify the thermal properties of the fiber or confer a range of physical properties derived from the physical property activity of the additive including electrical, optical, density-related, liquid barrier or adhesive tack related properties.

The fibers of the web can be rather uniform in diameter over most of their length and independent from other fibers to obtain webs having desired loft properties. Lofts of 90 percent (the inverse of solidity and comprising the ratio of the volume of the air in a web to the total volume of the web multiplied by 100) or more can be obtained and are useful for many purposes such as filtration or insulation. Even the less-oriented fiber segments preferably have undergone some orientation that enhances fiber strength along the full length of the fiber. Other fiber components that are not crystalline, e.g., styrenic block copolymers, can still benefit from orientation.

Fibers also may be formed from blends of materials, including materials into which certain additives have been blended, such as pigments or dyes. In addition, different fiber components may be extruded through different orifices of the extrusion head so as to prepare webs that comprise a mixture of fibers. In other embodiments of the presently disclosed invention other materials are introduced into a stream of fibers prepared according to the invention before or as the fibers are collected so as to prepare a blended web. For example, other staple fibers may be blended in the manner taught in U.S. Patent No. 4,118,531; or particulate material may be introduced and captured within the web in the manner taught in U.S. Pat. No. 3,971,373; or microwebs as taught in U.S. Pat. No. 4,813,948 may be blended into the webs. Alternatively, fibers prepared according to the present disclosure may be introduced into a stream of other fibers to prepare a blend of fibers.

As another unique characteristic of useful fibers and webs, in some collected webs fibers are found that are interrupted, i.e., are broken, or entangled with themselves or other fibers, or otherwise deformed as by engaging a wall of the processing chamber. The fiber segments at the location of the interruption, i.e., the fiber segments at the point of a fiber break, and the fiber segments in which an entanglement or deformation occurs, are all termed an interrupting fiber segment herein, or more commonly for shorthand purposes, are often simply termed "fiber ends". These interrupting fiber segments form the terminus or end of an unaffected length of fiber, even though in the case of entanglements or deformations there often is no actual break or severing of the fiber. Such interrupting fiber segments are described in greater detail in issued U.S. Pat. No. 6,607,624.

The fiber ends have a fiber form (as opposed to a globular shape as sometimes obtained in meltblowing or other previous methods) but are usually enlarged in diameter over the medial or intermediate portions of the fiber; usually they are less than 300 micrometers in diameter. Often, the fiber ends, especially broken ends, have a curly or spiral shape, which causes the ends to entangle with themselves or other fibers.

2. Elastic Filament Component

The elastic nonwoven fibrous webs of the present disclosure include at least one elastic filament. In certain exemplary embodiments, the at least one elastic filament comprises a monofilament. In other exemplary embodiments, the at least one elastic filament comprises an at least partially fused multi-filament yarn. In certain presently preferred embodiments, the at least one elastic filament comprises a plurality of elastic filaments.

The elastic filament(s) can have varying degrees of elasticity, but preferably they are "elastomeric filament(s)." The term "elastomeric filament(s)" is regarded herein as meaning filaments that may be stretched under tension to at least 110% of their initial length, and when released from tension, will promptly retract to no more than 105% of their original length. Elastomeric filaments are especially needed for certain uses, and oriented elastomeric filaments make distinct contributions that elastic filaments of less stretchability or less elastic recovery cannot make. The term "elastic filaments" is regarded herein as describing a larger category of filaments, including filaments of a lesser stretchability, but which elastically recover at least partially from their stretched dimensions. An elastic filament generally is regarded herein as one that may be stretched to at least 125 percent of its original length before breaking, and upon release of tension from such a degree of stretch will retract at least 50% of the amount of elongation. In some exemplary embodiments, the at least one elastic filament 24 exhibits an elongation to break of at least 200%, and, when released from tension after stretching to twice an original length, retreats to no more than 125% of the original length.

A wide variety of materials may be used in an elastic filament. In some particular exemplary embodiments, the at least one elastic filament comprises a (co)polymer selected from a urethane block copolymer, a styrenic block copolymer, an aliphatic polyester, an aliphatic polyamide, and combinations thereof. One presently preferred elastic filament is Spandex, a urethane block copolymer available from Invista, Wilmington, Del. Spandex is produced as either a monofilament or a fused multifilament yarn in a variety of deniers. The deniers of Spandex filaments typically range from 20 to 4300. Lower deniers are preferred for applications where a high Stretch Ratio is desired for the elastic nonwoven fibrous web. Coarser yarns, with a denier of 1500 to 2240, are preferred where lower Stretch Ratio is desired.

With particular reference to block copolymers, it may be noted that the individual blocks of the copolymers may vary in morphology, as when one block is crystalline or semicrystalline and the other block is amorphous; the variation in morphology often exhibited by fibers of the presently disclosed invention is not such a variation, but instead is a more macro property in which several molecules participate in forming a generally physically identifiable portion of a fiber. While adjacent longitudinal segments may not differ greatly in diameter in webs of the presently disclosed invention, there may be significant variation in diameter from fiber to fiber.

3. Optional Additional Layers

The elastic nonwoven fibrous webs of the present disclosure may comprise additional layers. In some exemplary embodiments, at least one additional layer is formed adjoining at least one major side of the elastic nonwoven fibrous web. One or more additional layers may be present over and/or under a surface of the elastic nonwoven fibrous web.

Suitable additional layers include, but are not limited to, a color-containing layer (e.g., a print layer); a support layer comprising one or more nonwoven fiber components such as a microfiber component, an ultrafine microfiber component, and/or a sub-micrometer fiber component; foams; layers of particles; foil layers; films; decorative fabric layers; membranes (i.e., films with controlled permeability, such as dialysis membranes, reverse osmosis membranes, etc.); netting; mesh; or a combination thereof.

4. Optional Attachment Devices

In certain exemplary embodiments, the elastic nonwoven fibrous webs of the present disclosure may further comprise one or more attachment devices to enable the elastic nonwoven fibrous article to be attached to a substrate. As discussed above, an adhesive may be used to attach the elastic nonwoven fibrous article. In addition to adhesives, other attachment devices may be used. Suitable attachment devices include, but are not limited to, any mechanical fastener such as screws, nails, clips, staples, stitching, thread, hook and loop materials, etc. Additional attachment methods include thermal bonding of the surfaces, for example, by application of heat or using ultrasonic welding.

The one or more attachment devices may be used to attach the elastic nonwoven fibrous article to a variety of substrates.

B. Methods of Making Elastic Nonwoven Fibrous Webs

1. Apparatus for Forming Elastic Nonwoven Fibrous Webs

In another aspect, the disclosure relates to an elastic nonwoven fibrous web comprising a plurality of nonwoven fibers and at least one elastic filament hydraulically entangled with at least a portion of said plurality of nonwoven fibers to form a web, wherein the web is self-supporting and exhibits elasticity. In one exemplary embodiment, the method for making the elastic nonwoven fibrous web comprises providing a plurality of nonwoven fibers; providing at least one elastic filament under a tension so as to stretch the at least one elastic filament from a relaxed state to a stretched state; entangling at least a portion of said plurality of nonwoven fibers with said at least one elastic filament while maintaining said at least one elastic filament under the tension; and releasing the tension so as to allow the at least one elastic filament to retract from the stretched state, thereby form a self-supporting, cohesive, elastic nonwoven fibrous web.

In certain presently preferred embodiments, entangling at least a portion of said plurality of nonwoven fibers with said at least one elastic filament comprises hydro-entangling. The basic operating procedure of hydro-entangling is described in, for example, U.S. Pat. No. 5,389,202 (Everhart et al.; see for example columns 8 and 9).

Additional description of the hydro-entanglement process and apparatus useful in practicing the hydro-entangling process is provided in U.S. Pat. Nos. 6,851,164 B2 (Andersen); 6,903,302 B1 (Putnam et al.); 7,091,140 B1 (Ferencz et al.); and Published PCT App. No. WO 03/048431 A1 (Bevan).

In some exemplary embodiments, the method further comprises drying the self-supporting, cohesive, elastic nonwoven fibrous web. Suitable hydro-entangling systems including web-drying components are commercially available; for example, the Hydrolace 350 Pilot System manufactured by CEL International, Ltd. (Coventry, England), which was used to produce the Examples which appear in this application.

Figure 2A:
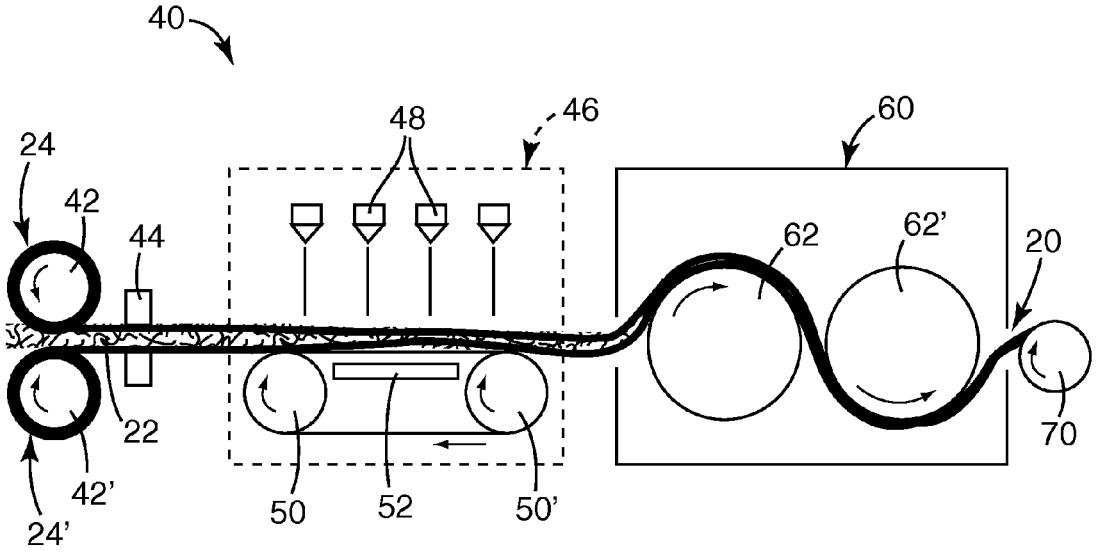
FIG. 2A is a schematic overall diagram of an exemplary apparatus useful for forming an elastic nonwoven fibrous web of the present disclosure.

FIG. 2A shows an illustrative apparatus 40 that can be used to prepare an exemplary elastic nonwoven fibrous web 20 according to the present disclosure. A plurality of nonwoven fibers 22, along with at least one elastic filament 24-24' (two elastic filaments 24 and 24' are shown in FIG. 2A for illustrative purposes only) are fed into a hydro-entangling processor 46, which hydraulically entangles the elastic filament(s) 24-24' with the plurality of nonwoven fibers 22. After passing through the hydro-entangling processor 46, the elastic nonwoven fibrous web 20 may be conveyed to other apparatus (not shown) such as a bonding oven, through-air bonder, calenders, embossing stations, laminators, cutters and the like, before being collected on wind-up roller 70.

An exemplary hydro-entangling processor 46 is shown in FIG. 2A. It will be understand that other hydro-entangling processors, including the processors illustrated in FIG. 2B, may additionally or alternatively be used. The hydro-entangling processor 46 typically may include a plurality of high-pressure water emitters or jets 48, a collector 52 for collecting (and optionally recycling) the emitted water, and optional web support mechanism 50-50', which is illustrated as an endless belt in FIG. 2A. In some exemplary embodiments, the high pressure water emitters or jets 48 may be advantageously positioned to impinge on the top side or surface of the plurality of nonwoven fibers 22. In other exemplary embodiments (not shown in FIG. 2A), the high pressure water emitters or jets 48 may be advantageously positioned to impinge on the bottom side or surface of the plurality of nonwoven fibers 22. In additional exemplary embodiments (not shown in FIG. 2A), the high pressure water emitters or jets 48 may be advantageously positioned to impinge on both the top and bottom sides or surfaces of the plurality of nonwoven fibers 22. Preferably, the high pressure water emitters or jets 48 are advantageously positioned to impinge on the plurality of nonwoven fibers 22 at a velocity and/or pressure high enough to cause lateral (i.e. cross-web) movement of the at least one elastic filament 24-24'.

Referring again to FIG. 2A, the elastic filaments 24-24' are preferably fed into the hydro-entangling processor 46 under tension at a defined Stretch Ratio. Tension is preferably maintained on the filaments by feeding the filaments from feed (unwind) rollers 42-42' to take-up (wind-up) roller 70. The desired Stretch Ratio may be controlled by controlling the relative rotational velocities of feed rollers 42-42' and take-up roller 70. Preferably, feed rollers 42-42' are operated at the same rotational velocity. Preferably, the rotational velocity of the feed rollers 42-42' is less than the rotational velocity of the take-up roller 70 (i.e., the feed rollers 42-42' operate underspeed relative to the take-up roller 70).

Although FIG. 2A illustrates an exemplary embodiment in which two individual elastic filaments 24 and 24' are each fed from a separate feed roller 42-42', it will be understood that other methods of feeding elastic filaments into the hydro-entangling process are within the scope of the present invention. Thus, in some exemplary embodiments (not shown in FIG. 2A), additional feed rollers may be used to feed more than two elastic filaments into the hydro-entangling process.

Furthermore, in additional exemplary embodiments (not shown in FIG. 2A), a plurality of elastic filaments may be simultaneously fed from a single feed roller using a preformed arrangement of individual elastic filaments prewound onto the feed roller in a manner which allows the plurality of elastic filaments to be simultaneously unwound from the feed roller as a "beam" of substantially parallel, non-overlapping filaments arranged in a plane. Such prewound individual elastic filaments (e.g. SPANDEX filaments) may be obtained, for example, from Globe Manufacturing, Fall River, Mass.

When more than one elastic filament 24-24' is used in the process, the filaments 24-24' are preferably fed through a filament spacing comb 44 positioned proximate the first hydro-entanglement jet head in order to keep the filaments separated until the onset of the hydro-entangling process. This filament spacing comb 44, which includes a plurality of perforations or slot openings extending through the filament spacing comb 44 in the general direction of filament 24-24' movement through apparatus 40, is shown positioned near the first hydro-entanglement jet 48, and acts to maintain a separation between the filaments 24-24' until entering the hydro-entangling processor 46. In certain exemplary embodiments using more than one elastic filament, the filament spacing comb is preferably positioned as close as possible to the first hydro-entanglement jet head so as to maintain the desired separation and spacing between the elastic filaments right up to the point at which hydro-entanglement occurs.

The filament spacing is at least partially determined by the distance from the first of the hydro-entanglement jets 48 to the filament spacing comb 44. By positioning the filament spacing comb 44 near the first of the hydro-entanglement jets 48, the filament spacing may be maintained until the hydro-entangling process takes place with the plurality of nonwoven fibers 22. Further details of the filament spacing comb 44 are discussed in the context of FIG. 2C, below.

The plurality of nonwoven fibers 22 and the elastic filaments 24-24' are hydraulically entangled in the hydro-entangling processor 46 while the tension on the elastic filaments 24-24' is maintained. Upon exiting the hydro-entangling processor 46, the tension on the filaments 24-24' is reduced, thereby causing the elastic filaments 24-24' to relax, thereby mechanically locking the plurality of nonwoven fibers 22 into place around the filaments 24-24', without requiring an additional bonding step or use of an adhesive material to bond the filaments to the nonwoven fibers.

The exemplary elastic nonwoven fibrous web 20 may optionally be dried in drying unit 60, which is shown in FIG. 2A as including heated drying rollers 62 and 62', but which may additionally or alternatively include a stream of heated air (not shown) impinging on the elastic nonwoven fibrous web 20. Alternatively or additionally, drying rollers 62 and 62' may be vacuum dewatering drums as described further below. Suitable drying units or means are well known in the art; see e.g. U.S. Pat. Nos. 6,851,164 B2 (Andersen); 6,903,302 B1 (Putnam et al.); 7,091,140 B1 (Ferencz et al.); and Published PCT App. No. WO 03/048431 A1 (Bevan).

In some exemplary embodiments, the plurality of nonwoven fibers 22 may be provided in the form of at least one nonwoven fibrous web. The at least one nonwoven fibrous web is preferably pre-formed. As shown in FIG. 2A, in some embodiments, the nonwoven fibers 22 may be fed into hydro-entangling processor 46 as a single pre-formed web forming a middle layer between the elastic filaments 24-24'.

In other exemplary embodiments, the plurality of nonwoven fibers is provided in the form of two or more nonwoven fibrous webs. One or more of the nonwoven fibrous webs may be pre-formed. Alternatively or additionally, one or more of the nonwoven fibrous webs may be formed in-line as an input to the hydro-entangling processor. In certain exemplary embodiments, at least one of the two or more nonwoven fibrous webs comprises nonwoven fibers that differ from nonwoven fibers in at least one of the other nonwoven fibrous webs.

In certain exemplary embodiments, the at least one nonwoven fibrous web is substantially non-bonded prior to entering the hydro-entangling processor 46. In other exemplary embodiments, the at least one nonwoven fibrous web may be bonded before entering the hydro-entangling processor 46, for example autogeneously, thermally, or adhesively bonded. The hydro-entangling processor may then be used to break at least a portion of the bonds during the hydro-entangling process.

Figure 2B:
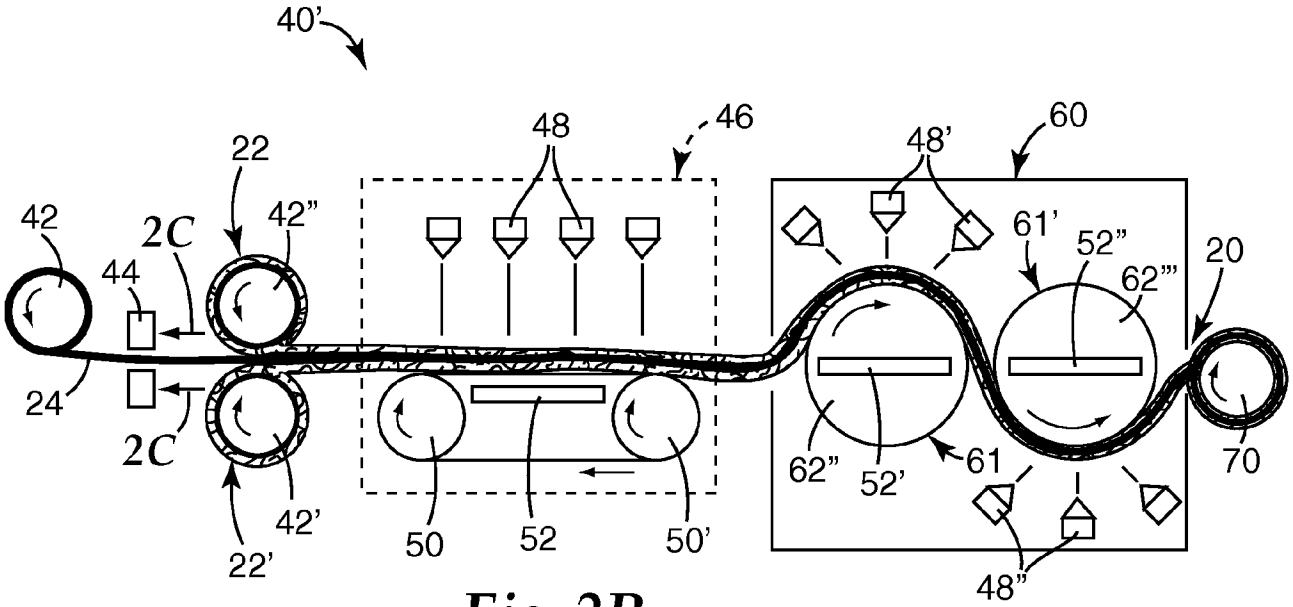
FIG. 2B is a schematic overall diagram of another exemplary apparatus useful for forming an elastic nonwoven fibrous web of the present disclosure.

FIG. 2B shows one exemplary apparatus 40 that can be used to prepare an exemplary elastic nonwoven fibrous web 20 according to the present disclosure, and in which the plurality of nonwoven fibers is provided in the form of two or more nonwoven fibrous webs 22 and 22'. At least one elastic filament (only one elastic filament 24 is shown in FIG. 2B for illustrative purposes only), sandwiched between the two or more nonwoven fibrous webs 22 and 22', is fed into an optional hydro-entangling processor 46, which hydraulically entangles the elastic filament(s) 24 with the plurality of nonwoven fibers in the two or more nonwoven fibrous webs 22 and 22. Preferably, a plurality of elastic filaments (not shown in FIG. 2B) is fed into the optional hydro-entangling processor 46.

In some additional or alternative embodiments, the at least one elastic filament 24 (which may be a plurality of elastic filaments) may be sandwiched between the two or more nonwoven fibrous webs 22 and 22', and fed into a drying unit 60, which optionally may include a plurality of downward directed high-pressure water emitters or jets 48', and/or upward directed high-pressure water emitters or jets 48". Drying unit 60 may thus serve as both a hydro-entangling processor and a drying unit, either in conjunction hydro-entangling processor 46, or as an alternative to hydro-entangling processor 46.

After passing through the optional hydro-entangling processor 46 and/or the drying unit 60 (optionally configured with one or more high-pressure water emitters or jets 48'-48"), the elastic nonwoven fibrous web 20 may be conveyed to other apparatus (not shown in FIG. 2B) such as a bonding oven, through-air bonder, calenders, embossing stations, laminators, cutters and the like, before being collected on wind-up roller 70.

The optional hydro-entangling processor 46 typically may include a plurality of high-pressure water emitters or jets 48, a collector 52 for collecting (and optionally recycling) the emitted water, and optional web support mechanism 50-50', which is illustrated as an endless belt in FIG. 2B. In some exemplary embodiments (not shown in FIG. 2B), the high pressure water emitters or jets 48 may be advantageously positioned to impinge on the top side or surface of the plurality of nonwoven fibers comprising at least a first nonwoven fibrous web 22.

In other exemplary embodiments (not shown in FIG. 2B), the high pressure water emitters or jets 48 may be advantageously positioned to impinge on the bottom side or surface of the plurality of nonwoven fibers comprising at least a second nonwoven fibrous web 22'. In additional exemplary embodiments (not shown in FIG. 2B), the high pressure water emitters or jets 48 may be advantageously positioned to impinge on both the top and bottom sides or surfaces of the plurality of nonwoven fibers (i.e. to impinge on at least the first 22 and second 22' nonwoven fibrous webs.

In other exemplary embodiments shown in FIG. 2B, high pressure water emitters or jets 48'-48" may be additionally or alternatively positioned within the drying unit 60 to impinge upon one or both of the first 22 and second 22' nonwoven fibrous webs. Preferably, the high pressure water emitters or jets 48'-48" are advantageously positioned to impinge on the plurality of nonwoven fibers at a velocity and/or pressure high enough to cause lateral (i.e. cross-web) movement of the at least one elastic filament 24, which preferably comprises a plurality of elastic filaments.

Referring again to FIG. 2B, the at least one elastic filament 24, which preferably comprises a plurality of elastic filaments, is preferably fed into the optional hydro-entangling processor 46 and/or drying unit 60 (optionally including high pressure water emitters or jets 48'-48") under tension at a defined Stretch Ratio. Tension is preferably maintained on the filament(s) by feeding the filament(s) from feed (unwind) roller 42 to take-up (wind-up) roller 70. The desired Stretch Ratio may be controlled by controlling the relative rotational velocity of feed roller 42 and take-up roller 70. Preferably, the rotational velocity of the feed roller 42 is less than the rotational velocity of the take-up roller 70 (i.e., the feed roller 42 operates underspeed relative to the take-up roller 70). Multiple feed rollers (not shown in FIG. 2B) may also be used as described below; however, if multiple feed rollers are used, they are preferably operated at substantially the same rotational velocity.

Although FIG. 2B illustrates an exemplary embodiment in which an individual elastic filament 24 is fed from a separate feed roller 42, it will be understood that other methods of feeding elastic filaments into the hydro-entangling process are within the scope of the present invention. Thus, in some exemplary embodiments (not shown in FIG. 2B), additional feed rollers may be used to feed more than one elastic filament into the hydro-entangling process.

Furthermore, in additional exemplary embodiments (not shown in FIG. 2B), a plurality of elastic filaments may be simultaneously fed from a single feed roller using a pre-formed arrangement of individual elastic filaments pre-wound onto the feed roller in a manner which allows the plurality of elastic filaments to be simultaneously unwound from the feed roller as a "beam" of substantially parallel, non-overlapping filaments arranged in a plane. Such pre-wound individual elastic filaments (e.g. SPANDEX filaments) may be obtained, for example, from Globe Manufacturing, Fall River, Mass.

When more than one elastic filament is used in the process, the filaments are preferably fed through a filament spacing comb 44 positioned proximate the first hydro-entanglement jet head in order to keep the filaments separated until the onset of the hydro-entangling process. In certain exemplary embodiments using more than one elastic filament, the filament spacing comb is preferably positioned as close as possible to the position at which the at least one elastic filament is sandwiched between the two or more nonwoven fibrous webs 22 and 22', as shown in FIG. 2B. In certain presently preferred embodiments, the filament spacing comb 44 is positioned immediately before unwind rollers 42' and 42" for first 22 and second 22' nonwoven fibrous webs, as shown in FIG. 2B.

Preferably, filament spacing comb 44 and unwind rollers 42' and 42" are positioned as close as possible to the first hydro-entanglement jet head so as to maintain the desired separation and spacing between the elastic filaments right up to the point at which hydro-entanglement occurs. The filament spacing is at least partially determined by the distance from the first of the hydro-entanglement jets 48 to the filament spacing comb 44. By positioning the filament spacing comb 44 near the first of the hydro-entanglement jets 48, the filament spacing may be maintained until the hydro-entangling process takes place with the plurality of nonwoven fibers comprising nonwoven fibrous webs 22 and 22'.

Figure 2C:
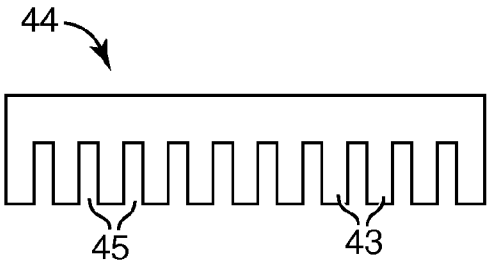
FIG. 2C is a sectional end view of the comb 44 of FIG. 2B, taken along view lines 2C.

FIG. 2C is a sectional end view of an exemplary filament spacing comb 44 of FIG. 2C, taken along view lines 2C as shown in FIG. 2B. Filament spacing comb 44, which includes a plurality of slot openings 45 formed between a plurality of teeth 43, acts to maintain a separation between the plurality of filaments 24 right up to the point at which hydro-entanglement occurs. FIG. 2C illustrates but one possible configuration of a suitable filament spacing comb 44, in which the slot openings 24 are generally rectangular and are oriented in a general downward direction. Other configurations are possible. For example, the slot openings 45 may have another shape; for example, the slot openings 45 may be a plurality of round or oval perforations (not shown in FIG. 2C). In addition, the filament spacing comb 44 may be oriented with the plurality of slot openings 45 oriented in a general upward direction (not shown), for example, by positioning the plurality of teeth 43 pointing upward (not shown in FIG. 2C).

In additional exemplary embodiments, the number of slot openings 45 and their spacing between teeth 43 in filament spacing comb 44 may be varied to control the spacing between filaments 24 in the resulting elastic nonwoven fibrous web 20. Furthermore, in additional exemplary embodiments in which a plurality of elastic filaments 24 is used, a single filament may be positioned within and passed through each slot opening 45, or alternatively, a single filament 45 may be positioned in and passed through every second slot opening, every third slot opening, every fourth slot opening, every fifth slot opening, etc., in order to increase the separation distance between adjacent elastic filaments 24. In this manner, the number of elastic filaments per unit length of cross-web direction may be varied (in the cross-web direction).

Preferably, the elastic filaments 45 are evenly spaced in the cross-web direction. However, in other exemplary embodiments, the elastic filaments 45 are unevenly spaced in the cross-web direction. In some exemplary embodiments, it may be advantageous to configure two or more filaments to pass through a single slot opening 45.

Referring again to FIG. 2B, the plurality of nonwoven fibers comprising first 22 and second 22' nonwoven fibrous webs, and the at least one elastic filament 24 may be hydraulically entangled in the hydro-entangling processor 46 and/or drying unit 60 (optionally including high pressure water emitters or jets 48'-48"), preferably while the tension on the at least one elastic filament 24 is maintained. Upon exiting the hydro-entangling processor 46 and/or drying unit 60 (optionally including high pressure water emitters or jets 48'-48"), the tension on the at least one elastic filament 24 is reduced, thereby causing the elastic filament 24 to relax, thereby mechanically locking the plurality of nonwoven fibers comprising nonwoven fibrous webs 22 and 22', into place around the filament 24, without requiring an additional bonding step or use of an adhesive material to bond the filaments to the nonwoven fibers.

The exemplary elastic nonwoven fibrous web 20 may optionally be dried in drying unit 60, which is shown in FIG. 2B as including vacuum dewatering drums 62" and 62'". As noted above, high pressure water emitters or jets 48'-48" may be additionally or alternatively positioned within the drying unit 60 to impinge upon one or both of the first 22 and second 22' nonwoven fibrous webs. Preferably, the high pressure water emitters or jets 48'-48" are advantageously positioned to impinge on the plurality of nonwoven fibers at a velocity and/or pressure high enough to cause lateral (i.e. cross-web) movement of the at least one elastic filament 24, which preferably comprises a plurality of elastic filaments. In some exemplary embodiments, the surfaces 61 and 61' of vacuum dewatering drums 62" and 62'" comprise a porous or perforated surface, thereby enabling a vacuum to be drawn by vacuum dewatering devices 52' and 52" through the surfaces 61 and 61', respectively, to facilitate removal of water from nonwoven fibrous web 20 during or subsequent to the hydro-entangling process.

Although vacuum dewatering trays or pans 52'-52" are illustrated in FIG. 2B, other configurations, including wedge shaped vacuum dewatering devices conforming to at least a portion of the inner cylindrical surface of the vacuum dewatering drums 62" and 62'", may also be used. Suitable vacuum drying drums are well known in the art; see e.g. U.S. Pat. Nos. 6,851,164 B2 (Andersen); 6,903,302 B1 (Putnam et al.); 7,091,140 B1 (Ferencz et al.); and Published PCT App. No. WO 03/048431 A1 (Bevan). One particularly useful vacuum drying drum is provided, for example, with the Hydrolace 350 Pilot System manufactured by CEL International, Ltd. (Coventry, England), which was used to produce the Examples within this application In some presently preferred embodiments, the surfaces 61 and 61' of vacuum dewatering drums 62" and 62'" comprise a screen or mesh surface, which surface may be removable, and which surface is preferably is seamless. In some embodiments, the screen or mesh is a woven thermoplastic material (such as nylon or polypropylene). The mesh size of the screen may be selected to vary the properties of the elastic nonwoven fibrous web 20. A finer mesh may be preferred to retain the plurality of nonwoven fibers on the surfaces 61 and 61' of vacuum dewatering drums 62" and 62'", permitting more lateral movement of the elastic filaments during hydro-entangling on the drum surfaces, thereby leading to a tighter, more dense, less soft elastic nonwoven fibrous web 20. A coarser mesh may be preferred to aid dewatering, thereby leading to a more open, less dense, softer structure, albeit with the possibility that a portion of each elastic filament may be exposed.

Figure 2D:
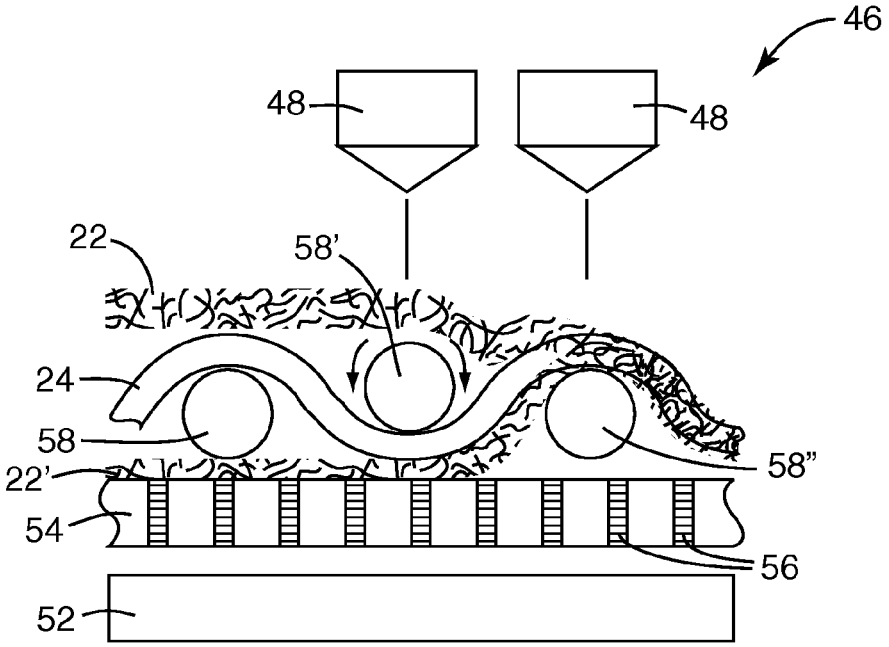
FIG. 2D is an enlarged side view of another exemplary hydro-entanglement processing system useful for forming an elastic nonwoven fibrous web of the present disclosure.
Figure 3A:
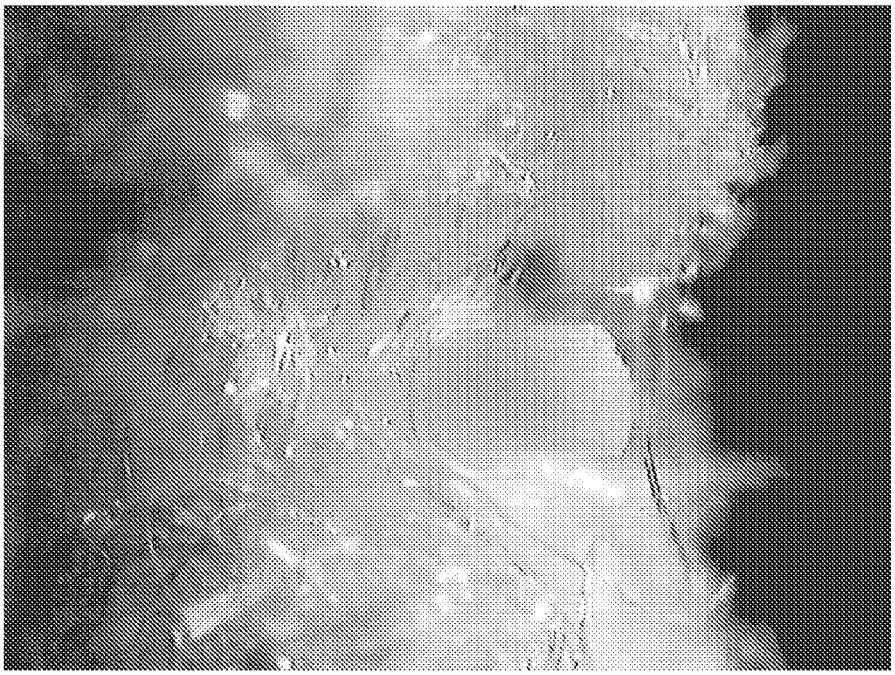
FIGS. 3A-3C are photomicrographs illustrating an exemplary elastic nonwoven fibrous web of the present disclosure.
Figure 3B:
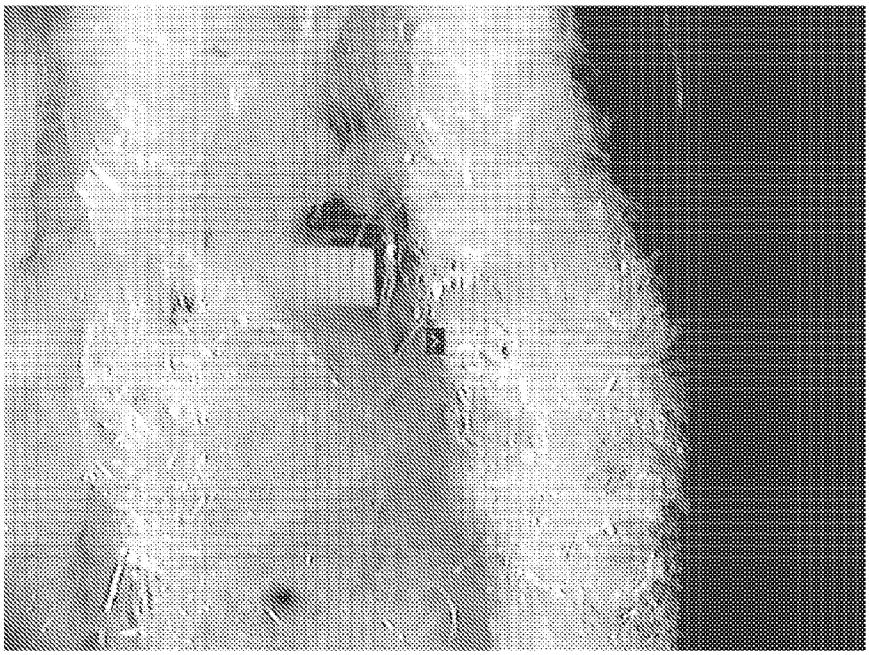
Figure 3C:
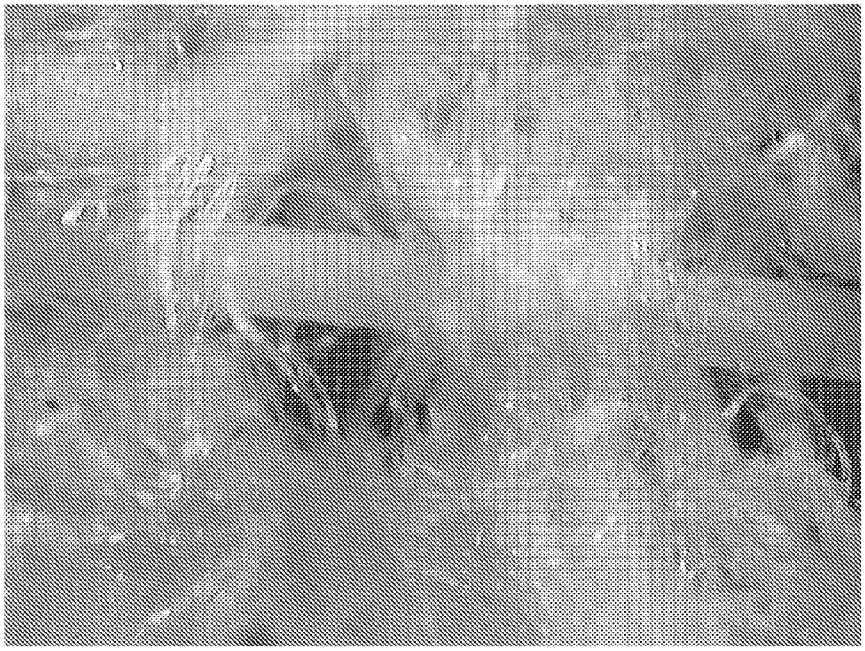

Turning now to FIG. 2D, in some exemplary embodiments, the hydro-entangling processor 46 may include at least one high-pressure water emitter or jet 48, a collector 52 for collecting (and optionally recycling) the emitted water, and optional serpentine rollers 58-58'-58", which direct the at least one elastic filament 24 in a serpentine path as the plurality of nonwoven fibers is introduced as at least one pre-formed web 22 that overlays and is hydraulically entangled with the at least one elastic filament 24 within the hydro-entangling processor 46. An optional support platform 54, comprising a plurality of pores or perforations 56 extending through the surface of the support platform 54, may be advantageously used to draw water to the collector by applying a partial vacuum across the pores or perforations 56.

FIG. 2D also shows an optional second pre-formed web 22' comprising a plurality of nonwoven fibers that underlays and is hydraulically entangled with the at least one elastic filament 24. Preferably, the optional second pre-formed web 22' passes over at least one optional serpentine roller 58" with the elastic filament 24, in order to augment the hydro-entangling provided by the at least one high-pressure water emitter or jet 48. Additional pre-formed webs comprising the plurality of nonwoven fibers may also be used (not shown in FIG. 2D).

In further exemplary embodiments, the nonwoven fibrous webs used in the foregoing hydro-entangling processes may contain a mixture of fibers in a single layer (made for example, using two closely spaced die cavities sharing a common die tip), a plurality of layers (made for example, using a plurality of die cavities arranged in a stack), or one or more layers of multi-component fibers (such as those described in U.S. Pat. No. 6,057,256 to Krueger et al.).

2. Optional Processing Steps for Producing Elastic nonwoven Fibrous Webs

In preparing spunbond filaments according to various embodiments of the present disclosure, different filament-forming materials may be extruded through different orifices of a meltspinning extrusion head so as to prepare webs that comprise a mixture of filaments. Various procedures are also available for electrically charging a nonwoven fibrous web to enhance its filtration capacity, see, e.g., U.S. Pat. No. 5,496,507 (Angadjivand).

In addition to the foregoing methods of making a elastic nonwoven fibrous web, one or more of the following process steps may be carried out on the web once formed:

(1) advancing the elastic nonwoven fibrous web along a process pathway toward further processing operations;

(2) bringing one or more additional layers into contact with an outer surface of the elastic nonwoven fibrous web;

(3) calendering the elastic nonwoven fibrous web;

(4) coating the elastic nonwoven fibrous web with a surface treatment or other composition (e.g., a fire retardant composition, an adhesive composition, or a print layer);

(5) attaching the elastic nonwoven fibrous web to a cardboard or plastic tube;

(6) winding-up the elastic nonwoven fibrous web in the form of a roll;

(7) slitting the elastic nonwoven fibrous web to form two or more slit rolls and/or a plurality of slit sheets;

(8) placing the elastic nonwoven fibrous web in a mold and molding the elastic nonwoven fibrous web into a new shape;

(9) applying a release liner over an exposed optional pressure-sensitive adhesive layer, when present; and

(10) attaching the elastic nonwoven fibrous web to another substrate via an adhesive or any other attachment device including, but not limited to, clips, brackets, bolts/screws, nails, and straps.

C. Methods of Using Elastic Nonwoven Fibrous Webs

The present disclosure is also directed to methods of using the elastic nonwoven fibrous webs of the present disclosure in a variety of applications. In yet another aspect, the disclosure relates to articles comprising the composite nonwoven fibrous webs described above prepared according to the foregoing methods. The mechanical locking of the fibers to themselves as well as the elastic filaments from the high-pressure water jets produces a nonwoven fibrous web that exhibits good elasticity when stretched.

Elastic nonwoven fibrous webs according to the present disclosure are unique in that they do not require heat, adhesives, or binders to hold together the nonwoven fibers and the at least one elastic filament. Therefore, many current processing steps and components necessary to produce known elastic fibrous webs may be eliminated.

Furthermore, there is the potential to create lower cost elastic fibrous webs while maintaining the ability to add other properties to this web construction unlike traditional elastic webs. This may provide flexibility to construct elastic webs having carefully tailored properties for medical, filtration, personal hygiene, and wiping articles. For example, hydrophilic components, hydrophobic components, and mechanical hook-and-loop fasteners may be readily incorporated into the elastic nonwoven fibrous webs of the present disclosure. Furthermore, other desirable properties may be incorporated into elastic nonwoven fibrous webs according to the present disclosure, including, for example, high Stretch Ratio, good web integrity and cohesiveness, biodegradability, and the like.

Exemplary articles incorporating certain elastic nonwoven fibrous webs according to the present disclosure may be useful as a wound dressing article, a personal hygiene article, a surface cleaning article, a gas filtration article, a liquid filtration article, a sound absorption article, or a thermal insulation article. For example, exemplary elastic nonwoven fibrous webs of the present disclosure may be useful in providing a breathable wound dressing material. Exemplary elastic nonwoven fibrous webs of the present disclosure may also be useful as a medical compressive dressing wrap or a sports support wrap. In some embodiments, elastic nonwoven fibrous webs of the present disclosure may also be useful in diapers or other personal hygiene articles, such as disposable garments.

Exemplary elastic nonwoven fibrous webs of the present disclosure may provide a particularly effective surface for use in a wipe for surface cleaning, because the web surface may have the advantage of providing a reservoir for cleaning agents and high surface for trapping debris. Certain exemplary elastic nonwoven fibrous webs of the present disclosure may also be useful in providing a fluid distribution layer when used for gas or liquid filtration. Other exemplary elastic nonwoven fibrous webs of the present disclosure may be useful as a breathable, high surface area material for use as a thermal or acoustical dampening insulation.

EXAMPLES

Exemplary embodiments have been described above and are further illustrated below by way of the following Examples, which are not to be construed in any way as imposing limitations upon the scope of the presently described invention. On the contrary, it is to be clearly understood that resort may be had to various other embodiments, modifications, and equivalents thereof which, after reading the description herein, may suggest themselves to those skilled in the art without departing from the spirit of the present disclosure and/or the scope of the appended claims. Furthermore, notwithstanding that the numerical ranges and parameters setting forth the broad scope of the disclosure are approximations, the numerical values set forth in the specific examples are reported as precisely as possible. Any numerical value, however, inherently contain certain errors necessarily resulting from the standard deviation found in their respective testing measurements. At the very least, and not as an attempt to limit the application of the doctrine of equivalents to the scope of the claims, each numerical parameter should at least be construed in light of the number of reported significant digits and by applying ordinary rounding techniques.

Test Methods

The elastic nonwoven fibrous webs of the invention were evaluated according to the following test methods.

Slip Test

Test samples were cut from the web in the cross-web/transverse direction (CD). A reference mark was made on the test sample 1 inch (2.5 cm) down-web from the cut end. The test sample was then pulled by the cut with a tweezers while holding (e.g. clamping) the web at the 1 inch (2.5 cm) reference mark. The nonwoven web sample was measured to see how far the Spandex filament retracted into the web from the cut end of the sample.

Dry Test

A 0.5 inch (1.27 cm) test sample of the web was cut in the cross-web/transverse direction, and subsequently pulled apart by placing the sample in tension from both ends in the down-web direction. The sample was then measured for length.

The Wet Test

A 0.5 inch (1.27 cm) web sample of the wet web was cut in the cross-web direction, and subsequently pulled apart by placing the sample in tension from both ends in the down-web direction. The sample was then measured for length.

The Stretch Ratio Test

A 4 inch (10.16 cm) piece of web was cut in the cross-web direction and measured in the relaxed state, then stretched to its full (maximum) extension, and measured. The ratio of the extended length to the non-extended (relaxed) length was taken as the measured Stretch Ratio.

The Dry Basis Weight Test

A 10×10 cm (0.01 $m^2$ area) square sample of the dry web was weighed, and the Dry Basis Weight expressed as the ratio of web weight to web area, expressed in grams per square meter (gsm).

The Wet Basis Weight Test

A 10×10 cm (0.01 $m^2$ area) square web sample was submerged in water for 30 seconds, removed, drip-dried for 30 seconds, and weighed. The Wet Basis Weight was expressed as the ratio of wet web weight to web area, expressed in gsm.

Example 1

An elastic nonwoven fibrous web was produced on a hydroentangling apparatus as shown generally in FIG. 2B except module 46 was bypassed. The hydroentangling apparatus used was a Hydrolace 350 pilot system obtained from CEL International Ltd. (Coventry, England). The apparatus (40') included a hydro-entangling processor (60) having six individual high pressure water jets capable of producing 3000 psi (20,684 kPa) water jet pressure. Three of the water jets (48') were configured to impact the elastic nonwoven web from the top-side of vacuum drum 62", and three of the water jets (48') were configured to impact the elastic nonwoven web from the bottom-side of vacuum drum 62'", as shown in FIG. 2B. The water jet pressure was 150 bar (15,000 kPa), and the web speed was 10 feet per minute (3.1 meters per minute). Vacuum dewatering drums 62" and 62'" were equipped with a perforated stainless steel mesh over which was placed an optional open woven thermoplastic mesh screen. Suitable thermoplastic mesh materials were obtained from Albany International Engineered Fabrics, Inc. (Menasha, Wis.).

A beam of 420 denier SPANDEX elastic filaments (obtained from Globe Manufacturing, Fall River, Mass.) was unwound with the individual filaments fed under tension at a processing Stretch Ratio of 2.2:1, obtained by operating the elastic filament feed roller 42 underspeed relative to the take-up roller 70, into the hydro-entangling process illustrated generally by FIG. 2B. The elastic filaments were fed through a filament spacing comb (44) to provide approximately 4 filaments per centimeter and then sandwiched between a top preformed (unbonded) polyethylene spunbond nonwoven web (28 grams/sq. meter, obtained from PGI, Charlotte, N.C.) introduced from above the filaments and a bottom woven polyester mesh/scrim (20 grams/sq. meter, obtained from American Fiber & Finishing, Albemarle, N.C.) introduced from below the filaments.

The nonwoven/elastic filament sandwich was then fed into the hydro-entangling processor (60). The nonwoven and woven fibers and the elastic filaments were hydraulically entangled while the tension on the elastic filaments was maintained. The tension on the filaments was released subsequent to the hydro-entangling process resulting in the elastic nonwoven web contracting/shirring to the initial zero tension state of the elastic filaments. The nonwoven and woven fibers remained locked in place around the filaments, without requiring an additional bonding step or use of an adhesive material to bond the filaments to the nonwoven fibers. The elastic nonwoven fibrous web was wound into a continuous roll and allowed to air dry for a minimum of 48 hours prior to testing. No thermoplastic mesh was used on the surface of the second vacuum drum 62'".

Example 2

An elastic nonwoven fibrous web was produced as in Example 1 except the bottom woven polyester scrim was replaced with a polyester spunlaced nonwoven web (34 grams/sq. meter, obtained from BBA Nonwovens, Simpsonville, S.C.). A Stretch Ratio of 2.2:1 was used for the elastic filaments. The thermoplastic mesh used on the surface of the second vacuum drum 62'" was Formtech 10 obtained from Albany International Engineered Fabrics, Inc. (Menasha, Wis.).

Example 3

An elastic nonwoven fibrous web was produced as in Example 2, except that the thermoplastic mesh used on the surface of the second vacuum drum 62''' was Formtech 6 obtained from Albany International Engineered Fabrics, Inc. (Menasha, Wis.).

Example 4

An elastic nonwoven fibrous web was produced as in Example 2, except that the thermoplastic mesh used on the surface of the second vacuum drum 62''' was Formtech 8 obtained from Albany International Engineered Fabrics, Inc. (Menasha, Wis.).

Example 5

An elastic nonwoven fibrous web was produced generally as in Example 2.

Example 6

An elastic nonwoven fibrous web was produced generally as in Example 2.

Example 7

An elastic nonwoven fibrous web was produced as in Example 2, except that the thermoplastic mesh used on the surface of the second vacuum drum 62''' was Filtratech 15H obtained from Albany International Engineered Fabrics, Inc. (Menasha, Wis.).

Example 8

An elastic nonwoven fibrous web was produced generally as in Example 2.

Example 9

An elastic nonwoven fibrous web was produced as in Example 2, except that the thermoplastic mesh used on the surface of the first vacuum drum 62" was Formtech 10 obtained from Albany International Engineered Fabrics, Inc. (Menasha, Wis.).

Example 10

An elastic nonwoven fibrous web was produced as in Example 1, except the top nonwoven web was a carded fiber blend of polyester (60%)/rayon (30%)/T-254 (10%) fibers (polyester fibers available from Wellman, Inc. (St. Louis, Miss.); rayon fibers available from Lenzing Fibers, Inc. (New York, N.Y.); T-254 "melty" fiber available from Kosa, GmbH (Frankfurt, Germany)), and the bottom web was a 40 gram/sq. meter polyester rando web obtained by feeding polyester fibers (available from Wellman, Inc. (St. Louis, Miss.)) into a RANDO-WEB process as generally described in U.S. Pat. No. 5,082,720, using an apparatus provided by Rando Machine Corp. (Macedon, N.Y.). In addition, the water jet pressure was reduced to 100 bar (10,000 kPa) for the first water jet impinging on vacuum drum 62", and 120 bar (12,000 kPa) for the second water jet impinging on drum 62".

Example 11

An elastic nonwoven fibrous web was produced as in Example 10 except the top nonwoven web was a polyester spunlaced nonwoven web (34 grams/sq. meter, obtained from BBA Nonwovens, Simpsonville, S.C.).

Example 12

An elastic nonwoven fibrous web was produced as in Example 11 except the bottom nonwoven web was a 30 gram/sq. meter polyester rando web obtained by feeding polyester fibers (available from Wellman, Inc. (St. Louis, Miss.)) into a RANDO-WEB process as generally described in U.S. Pat. No. 5,082,720, using an apparatus provided by Rando Machine Corp. (Macedon, N.Y.).

Example 13

An elastic nonwoven fibrous web was produced as in Example 11 except the bottom nonwoven web was a 20 gram/sq. meter polyester rando web obtained by feeding polyester fibers (available from Wellman, Inc. (St. Louis, Miss.)) into a RANDO-WEB process as generally described in U.S. Pat. No. 5,082,720, using an apparatus provided by Rando Machine Corp. (Macedon, N.Y.). In addition, the water jet pressure was reduced to 100 bar (10,000 kPa) for the second water jet impinging on vacuum drum 62", and 100 bar (10,000 kPa) for the third water jet impinging on drum 62".

Example 14

An elastic nonwoven fibrous web was produced as in Example 13 except the top nonwoven web was a 28 gram/sq. meter polyethylene spunbond web obtained from PGI Nonwovens (Waynesboro, Va.), and in addition, the water jet pressure was reduced to 120 bar (12,000 kPa) for the second water jet impinging on vacuum drum 62", and increased to 150 bar (15,000 kPa) for the third water jet impinging on drum 62".

Example 15

An elastic nonwoven fibrous web was produced as in Example 14 except the bottom nonwoven web was a 30 gram/sq. meter polyester rando web obtained by feeding polyester fibers (available from Wellman, Inc. (St. Louis, Miss.)) into a RANDO-WEB process as generally described in U.S. Pat. No. 5,082,720, using an apparatus provided by Rando Machine Corp. (Macedon, N.Y.).

Example 16

An elastic nonwoven fibrous web was produced as in Example 14 except the bottom nonwoven web was a 20 gram/sq. meter polyester rando web obtained by feeding polyester fibers (available from Wellman, Inc. (St. Louis, Miss.)) into a RANDO-WEB process as generally described in U.S. Pat. No. 5,082,720, using an apparatus provided by Rando Machine Corp. (Macedon, N.Y.). In addition, the water jet pressure was reduced to 100 bar (10,000 kPa) for the second water jet impinging on vacuum drum 62", and 100 bar (10,000 kPa) for the third water jet impinging on drum 62".

Example 17

An elastic nonwoven fibrous web was produced as in Example 1 except the top nonwoven web was a 30 gram/sq. meter carded rayon (1.5 denier, 3.8 cm length) available from Lenzing Fibers, Inc. (New York, N.Y.), and the bottom web was a 25 gram/sq. meter rayon (1.5 denier, 3.8 cm length) rando web obtained by feeding polyester fibers (available from Wellman, Inc. (St. Louis, Miss.)) into a RANDO-WEB process as generally described in U.S. Pat. No. 5,082,720, using an apparatus provided by Rando Machine Corp. (Macedon, N.Y.). In addition, the thermoplastic mesh used on the surface of the first vacuum drum 62" was Formtech 10, and the thermoplastic mesh used on the surface of the second vacuum drum 62'" was Formtech 6, both meshes obtained from Albany International Engineered Fabrics, Inc. (Menasha, Wis.). Furthermore, the water jet pressure was reduced to 25 bar (2,500 kPa) for the first water jet impinging on vacuum drum 62", 75 bar (7,500 kPa) for the second water jet impinging on vacuum drum 62", and 100 bar (10,000 kPa) for the third water jet impinging on drum 62".

Example 18

An elastic nonwoven fibrous web was produced as in Example 17 except that the thermoplastic mesh used on the surface of the first vacuum drum 62" was Formtech 10, and the thermoplastic mesh used on the surface of the second vacuum drum 62'" was Formtech 8, both meshes obtained from Albany International Engineered Fabrics, Inc. (Menasha, Wis.).

Example 19

An elastic nonwoven fibrous web was produced as in Example 18 except that the thermoplastic mesh used on the surface of the first vacuum drum 62" was Formtech 10, and the thermoplastic mesh used on the surface of the second vacuum drum 62'" was Filtratech 15H, both meshes obtained from Albany International Engineered Fabrics, Inc. Menasha, Wis.). Furthermore, the water jet pressure was reduced to 100 bar (10,000 kPa) for the three water jets impinging on vacuum drum 62'".

Example 20

An elastic nonwoven fibrous web was produced as in Example 19 except the applied hydro-entangling water jet pressure was reduced to 50 bar (5,000 kPa) for the second water jet impinging on vacuum drum 62", 75 bar (7,500 kPa) for the third water jet impinging on vacuum drum 62", and 75 bar (7,500 kPa) for the three water jets impinging on vacuum drum 62'".

Example 21

An elastic nonwoven fibrous web was produced as in Example 20, except the thermoplastic mesh used on the surface of the second vacuum drum 62'" was Filtratech 22A obtained from Albany International Engineered Fabrics, Inc. (Menasha, Wis.).

Example 22

An elastic nonwoven fibrous web was produced as in Example 21, except the applied hydro-entangling water jet pressure was reduced to 50 bar (5,000 kPa) for the three water jets impinging on vacuum drum 62'".

Example 23

An elastic nonwoven fibrous web was produced as in Example 22, except the applied hydro-entangling water jet pressure was increased to 100 bar (10,000 kPa) for the three water jets impinging on vacuum drum 62'".

Example 24

An elastic nonwoven fibrous web was produced as in Example 23, except the applied hydro-entangling water jet pressure was increased to 100 bar (10,000 kPa) for the third water jet impinging on drum 62".

Example 25

An elastic nonwoven fibrous web was produced as in Example 18 except the applied hydro-entangling water jet pressure was decreased to 100 bar (10,000 kPa) for the three water jets impinging on vacuum drum 62'".

Example 26

An elastic nonwoven fibrous web was produced as in Example 24, except the top nonwoven web was a 35 gram/sq. meter carded fiber blend of 90% polyester (1.5 denier, 3.8 cm length) and 10% T-254 bi-component "melty fibers" (polyester fibers available from Wellman, Inc. (St. Louis, Miss.); T-254 "melty" fiber available from Kosa, GmbH (Frankfurt, Germany)). In addition, the thermoplastic mesh used on the surface of the second vacuum drum 62'" was Filtratech 15H obtained from Albany International Engineered Fabrics, Inc. (Menasha, Wis.).

Example 27

An elastic nonwoven fibrous web was produced as in Example 26 except the top nonwoven web was a 35 gram/sq. meter carded fiber blend of 50% polyester (0.9 denier, 3.8 cm length), 40% polyester (1.5 denier, 3.8 cm length) and 10% T-254 bi-component "melty fibers" (polyester fibers available from Wellman, Inc. (St. Louis, Miss.).

Example 28

An elastic nonwoven fibrous web was produced as in Example 27 except the bottom rayon web is a carded web (1.5 denier, 3.8 cm length) having a basis weight of 30 grams/sq. meter.

Example 29

An elastic nonwoven fibrous web was produced as in Example 28 except the top nonwoven web was a 30 gram/sq. meter carded rayon web (1.5 denier, 3.8 cm length).

Example 30

An elastic nonwoven fibrous web was produced as in Example 27, except the bottom nonwoven web was a 35 gram/sq. meter carded fiber blend of 50% polyester (0.9 denier, 3.8 cm length), 40% polyester (1.5 denier, 3.8 cm length) and 10% T-254 bi-component "melty fibers" (polyester fibers available from Wellman, Inc. (St. Louis, Miss.).

In addition, the thermoplastic mesh used on the surface of the second vacuum drum 62'" was Filtratech 22A obtained from Albany International Engineered Fabrics, Inc. (Menasha, Wis.).

Example 31

An elastic nonwoven fibrous web was produced as in Example 30 except the thermoplastic mesh used on the surface of the second vacuum drum 62''' was Formtech 8 obtained from Albany International Engineered Fabrics, Inc. (Menasha, Wis.).

Example 32

An elastic nonwoven fibrous web was produced as in Example 29 except no thermoplastic mesh was used on the surface of the second vacuum drum 62'''.

Example 33

An elastic nonwoven fibrous web was produced as in Example 32 except the top rayon web had a basis weight of 40 grams/sq. meter and the bottom rayon web had a basis weight of 40 grams/sq. meter. In addition, a processing Stretch Ratio of 6.6:1 was used for the elastic filaments.

Example 34

An elastic nonwoven fibrous web was produced as in Example 33, except the applied hydro-entangling water jet pressure was increased to 125 bar (12,500 kPa) for the third water jet impinging on drum 62'', and 150 bar (15,000 kPa) for the three water jets impinging on vacuum drum 62'''.

Example 35

An elastic nonwoven fibrous web was produced as in Example 33 except the processing Stretch Ratio was 13:1.

Example 36

An elastic nonwoven fibrous web was produced as in Example 35, except no bottom web was used. In addition, a processing Stretch Ratio of 3.3:1 was used for the elastic filaments. Furthermore, the applied hydro-entangling water jet pressure was decreased to 100 bar (10,000 kPa) for the third water jet impinging on drum 62'', and the three water jets impinging on vacuum drum 62'''.

Example 37

An elastic nonwoven fibrous web was produced as in Example 36, except the top and bottom nonwoven webs were a 25 gram/sq. meter carded fiber blend of 60% splittable Wramp available from Kuraray Co. Ltd. (Tokyo, Japan), 30% rayon (1.5 denier, 3.8 cm length) available from Lenzing Fibers, Inc. (New York, N.Y.), and 10% T-254 bi-component "melty" fibers available from Kosa, GmbH (Frankfurt, Germany).

Example 38

An elastic nonwoven fibrous web was produced as in Example 37, except the applied hydro-entangling water jet pressure was decreased to 50 bar (5,000 kPa) for the third water jet impinging on drum 62''

Example 39

An elastic nonwoven fibrous web was produced as in Example 37, the applied hydro-entangling water jet pressure was increased to 125 bar (12,5000 kPa) and 150 bar (15,000 kPa) for the last two water jets impinging on vacuum drum 62'''.

Test Results

Samples of the elastic nonwoven fibrous webs of Examples 1-38 were subjected to the test methods as previously described. The results are shown in Table I.

TABLE 1

| Example | Slip Test (cm) | Dry Test (cm) | Wet Test (cm) | Measured Stretch Ratio | Dry Basis Weight (gsm) | Wet Basis Weight (gsm) |
|---|---|---|---|---|---|---|
| 1 | 6.4 | — | — | 2.5 | — | — |
| 2 | 3.8 | 2.8 | 2.5 | 2.25 | 185 | 254 |
| 3 | 0.6 | 2.7 | 3.0 | — | — | — |
| 4 | 1.6 | 2.7 | 2.8 | — | — | — |
| 5 | 1.2 | 2.6 | 3.0 | — | — | — |
| 6 | 1.2 | 2.6 | 2.5 | — | — | — |
| 7 | 0.6 | 2.3 | 2.8 | — | — | — |
| 8 | 0.8 | 2.3 | 2.7 | — | — | — |
| 9 | 2.5 | 2.5 | 2.4 | 2.38 | 163 | 311 |
| 10 | 0.7 | 2.5 | — | 2 | — | — |
| 11 | 1.4 | 2.5 | 2.3 | 2.31 | 205 | 283 |
| 12 | 1.1 | 2.0 | 2.0 | 1.88 | 147 | 195 |
| 13 | 1.7 | 1.9 | 2.4 | 2.1 | 149 | 312 |
| 14 | 0.6 | 2.1 | 2.3 | 2.25 | 146 | 228 |
| 15 | 0.4 | 2.2 | 2.4 | 2.19 | 126 | 198 |
| 16 | 0.6 | 2.1 | 2.4 | 2.31 | 155 | 278 |
| 17 | 0.8 | 1.8 | 2.8 | 2.1 | 231 | 1656 |
| 18 | 0.4 | 1.7 | 2.7 | 2.1 | 209 | 1352 |
| 19 | 0.6 | 2.2 | 3.6 | 2.25 | 210 | 1468 |
| 20 | 1.2 | 2.5 | 3.6 | 2.13 | 216 | 1543 |
| 21 | 1.1 | 2.0 | 3.2 | 2.13 | 191 | 1330 |
| 22 | 0.8 | 2.1 | 3.1 | 2.31 | 216 | 1505 |
| 23 | 1.1 | 2.1 | 3.3 | 2.56 | 230 | 1556 |
| 24 | 1.0 | 2.2 | 3.0 | 2 | 209 | 1450 |
| 25 | 1.3 | 2.5 | 3.3 | 2.56 | 217 | 1599 |
| 26 | 1.4 | 2.2 | 2.4 | 2.13 | 194 | 1376 |
| 27 | 1.2 | 1.9 | 2.3 | 2 | 191 | 1473 |
| 28 | 1.2 | 2.0 | 2.5 | 2 | 175 | 1506 |
| 29 | 1.3 | 2.0 | 3.0 | 2.13 | 160 | 1255 |
| 30 | 0.8 | 2.0 | 2.2 | 2 | 151 | 1327 |
| 31 | 1.5 | 2.4 | 2.5 | 2.38 | 196 | 1617 |
| 32 | 0.4 | 1.6 | 2.5 | 2 | 144 | 946 |
| 33 | 0.5 | 1.7 | 2.7 | 1.8 | 182 | 1142 |
| 34 | 0.9 | 1.5 | 2.1 | 1.75 | 176 | 1051 |
| 35 | 0.5 | 1.7 | 2.2 | 1.81 | 198 | 1162 |
| 36 | 1.3 | 2.5 | 3.2 | 2.62 | 95 | 906 |
| 37 | 0.4 | 1.5 | 1.8 | 2.3 | 155 | 1028 |
| 38 | 0.2 | 1.4 | 1.5 | 2.3 | 144 | 950 |
| 39 | 0.1 | 1.4 | 1.5 | 2.38 | 154 | 1009 |

Reference throughout this specification to "one embodiment," "certain embodiments," "one or more embodiments" or "an embodiment," whether or not including the term "exemplary" preceding the term "embodiment," means that a particular feature, structure, material, or characteristic described in connection with the embodiment is included in at least one embodiment of the presently described invention. Thus, the appearances of the phrases such as "in one or more embodiments," "in certain embodiments," "in one embodiment" or "in an embodiment" in various places throughout this specification are not necessarily referring to the same embodiment of the presently described invention. Furthermore, the particular features, structures, materials, or characteristics may be combined in any suitable manner in one or more embodiments.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. In particular, as used herein, the recitation of numerical ranges by endpoints is intended to include all numbers subsumed within that range (e.g., 1 to 5 includes 1, 1.5, 2, 2.75, 3, 3.80, 4, and 5). In addition, all numbers used herein are assumed to be modified by the term 'about'. Furthermore, all publications, published patent applications and issued patents referenced herein are incorporated by reference in their entirety to the same extent as if each individual publication or patent was specifically and individually indicated to be incorporated by reference. Various exemplary embodiments have been described. These and other embodiments are within the scope of the following claims.

The invention claimed is:

1. A method of forming an elastic nonwoven fibrous web comprising:

(a) providing a plurality of nonwoven fibers in the form of a pre-formed web;

(b) feeding a plurality of elastic filaments through a filament spacing comb in order to separate the filaments while under a tension so as to stretch the elastic filaments from a relaxed state to a stretched state;

(c) entangling at least a portion of said plurality of nonwoven fibers with said plurality of elastic filaments while maintaining the tension; and (d) releasing the tension so as to allow the plurality of elastic filaments to retract from the stretched state, thereby form a self-supporting, cohesive, elastic nonwoven fibrous web wherein the plurality of elastic filaments are substantially aligned in a down-web direction.

2. The method of claim 1, wherein the plurality of nonwoven fibers is provided in the form of two or more nonwoven fibrous webs, further wherein the plurality of elastic filaments is positioned between at least two of the two or more nonwoven fibrous webs.

3. The method of claim 2, wherein at least one of the two or more nonwoven fibrous webs comprises nonwoven fibers that differ from nonwoven fibers in at least one of the other nonwoven fibrous webs.

4. The method of claim 1, wherein the at least one nonwoven fibrous web is substantially non-bonded.

5. The method of claim 1, wherein the plurality of nonwoven fibers comprises fibers selected from the group consisting of microfibers, ultrafine microfibers, sub-micrometer fibers, and combinations thereof.

6. The method of claim 1, wherein the plurality of nonwoven fibers comprises fibers selected from the group consisting of meltblown fibers, melt spun fibers, air laid fibers, carded fibers, and combinations thereof.

7. The method of claim 1, wherein the plurality of nonwoven fibers comprises fibers selected from the group consisting of natural fibers, synthetic fibers, and combinations thereof.

8. The method of claim 1, wherein a filament spacing comb is used to maintain a separation between the plurality of elastic filaments prior to entangling at least a portion of said plurality of nonwoven fibers with said plurality of elastic filaments.

9. The method of claim 1, wherein entangling at least a portion of said plurality of nonwoven fibers with said elastic filaments comprises hydro-entangling.

10. The method of claim 9, further comprising drying the self-supporting, cohesive, elastic nonwoven fibrous web.

11. The method of claim 1, wherein the plurality of elastic filaments comprise a (co)polymer selected from the group consisting of a urethane block copolymer, a styrenic block copolymer, an aliphatic polyester, an aliphatic polyamide, and combinations thereof.

* * * * *